US009103229B2

(12) United States Patent
Eriksson

(10) Patent No.: US 9,103,229 B2
(45) Date of Patent: Aug. 11, 2015

(54) VANE TRAVEL ADJUSTMENT SCREW

(75) Inventor: Pontus Eriksson, Helsingborg (SE)

(73) Assignee: Volvo Lastvagnar AB, Göteborg (SE)

( * ) Notice: Subject to any disclaimer, the term of this patent is extended or adjusted under 35 U.S.C. 154(b) by 332 days.

(21) Appl. No.: 13/514,299

(22) PCT Filed: Dec. 7, 2009

(86) PCT No.: PCT/SE2009/000510
§ 371 (c)(1),
(2), (4) Date: Jun. 14, 2012

(87) PCT Pub. No.: WO2011/071422
PCT Pub. Date: Jun. 16, 2011

(65) Prior Publication Data
US 2012/0279217 A1 Nov. 8, 2012

(51) Int. Cl.

| | |
|---|---|
| ***F02D 23/00*** | (2006.01) |
| ***F02B 33/44*** | (2006.01) |
| ***F01D 17/12*** | (2006.01) |
| ***F01D 17/20*** | (2006.01) |
| ***F01D 17/16*** | (2006.01) |
| *F02B 37/24* | (2006.01) |

(52) U.S. Cl.
CPC ..... *F01D 17/20* (2013.01); *F01D 17/165* (2013.01); *F02B 37/24* (2013.01)

(58) Field of Classification Search
CPC ..... F01D 17/165; F02B 37/24
USPC ..... 60/602; 415/148–157
See application file for complete search history.

(56) References Cited

U.S. PATENT DOCUMENTS

| | | | | |
|---|---|---|---|---|
| 4,654,941 | A * | 4/1987 | Burdette et al. | 29/889.22 |
| 4,659,295 | A | 4/1987 | Burdette et al. | |
| 4,770,603 | A * | 9/1988 | Engels et al. | 415/147 |
| 4,780,054 | A * | 10/1988 | Yano et al. | 415/150 |

(Continued)

FOREIGN PATENT DOCUMENTS

| | | | |
|---|---|---|---|
| EP | 1120547 | A2 | 8/2001 |
| EP | 1236867 | A3 | 9/2005 |
| JP | 2003193851 | A | 7/2003 |

OTHER PUBLICATIONS

International Search Report dated Aug. 19, 2014 for corresponding International application No. PCT/SE2009/000510.

(Continued)

*Primary Examiner* — Thomas Denion
*Assistant Examiner* — Jessica Kebea
(74) *Attorney, Agent, or Firm* — WRB-IP LLP

(57) ABSTRACT

An arrangement is provided for controlling a variable position of vanes at a turbine in a flow channel of a turbine. The arrangement includes a nozzle ring carrying a set of vanes, each of the vanes being connected to a vane pin housed in the nozzle ring. A rotational position of the vanes is accomplished via a vane displacement drive train including a pivotally supported pivot axle, a first actuator arm arranged on the pivot axle, which first arm is connectable to a drive actuator, a second actuator arm arranged on the pivot axle, which second arm is connected to a pin engaged with an unison ring for pivoting the unison ring, and a vane arm being connected to each vane pin and the unison ring for displacement of the vanes via pivotal displacement of the unison ring, and wherein a stop screw is arranged for limiting the pivotal displacement of the vanes.

9 Claims, 8 Drawing Sheets

(56) References Cited

U.S. PATENT DOCUMENTS

| | | | | |
|---|---|---|---|---|
| 4,804,316 | A * | 2/1989 | Fleury | 417/407 |
| 4,927,325 | A | 5/1990 | Yano | |
| 5,146,752 | A * | 9/1992 | Bruestle | 60/602 |
| 5,187,935 | A * | 2/1993 | Akiyama et al. | 60/602 |
| 6,397,597 | B1 * | 6/2002 | Gartner | 60/605.2 |
| 8,523,511 | B2 * | 9/2013 | Love et al. | 415/1 |
| 2002/0023438 | A1 * | 2/2002 | Schmidt et al. | 60/602 |
| 2005/0169748 | A1 * | 8/2005 | Metz et al. | 415/160 |
| 2008/0110169 | A1 * | 5/2008 | Roh | 60/600 |
| 2009/0123272 | A1 * | 5/2009 | Love et al. | 415/148 |
| 2011/0171009 | A1 * | 7/2011 | Espasa et al. | 415/163 |
| 2013/0056325 | A1 * | 3/2013 | Ammon | 192/69 |
| 2014/0169949 | A1 * | 6/2014 | Tashiro et al. | 415/148 |

OTHER PUBLICATIONS

International Preliminary Report on Patentability dated Apr. 1, 2012 for corresponding International application No. PCT/SE2009/000510.

Supplementary European Search Report (Mar. 21, 2013) for corresponding European App. EP 09 85 2104.

* cited by examiner

VANE TRAVEL ADJUSTMENT SCREW

BACKGROUND AND SUMMARY

The invention relates to an arrangement for controlling a variable position of vanes in a flow channel of a turbine. The invention furthermore relates to a turbocharger for an engine including a turbine rotatably mounted on a shaft, a compressor impeller mounted on a shaft, a compressor housing having an inlet and an outlet and enclosing said compressor impeller, a center housing including bearing means for rotatably supporting the turbine shaft and compressor shaft, a turbine housing including an inlet and an outlet, said turbine housing forming a volute therein for directing exhaust gas from said engine through an annular passage to said turbine, and a flange member mounted between said center housing and said turbine housing, which turbocharger further includes an arrangement for controlling a variable position of vanes at a turbine inlet.

The invention also relates to an engine including a turbocharger unit.

Supercharged diesel internal combustion engines used in commercial vehicles are frequently equipped with turbochargers with variable inlet geometry such to adjustably set the effective turbine cross section. This is accomplished by adjusting the angular position of a set of vanes being arranged in an annular passageway in the turbine housing. The annular passageway is connecting the scroll shaped volute defined in a turbine housing to a turbine chamber where a turbine is located. Each vane is connected to a vane pin housed in a nozzle ring. The vane pin is connected to a vane arm which connects the vane pin with a unison ring. Pivotal movement of the unison ring enables simultaneous pivoting of the vanes in the annular passageway. The unison ring is pivotally arranged in a trace formed in the turbine housing or a flange member attached to the turbine housing. In order to accomplish the pivoting movement of the unison ring an unison ring displacement arrangement is provided. The unison ring displacement member includes a pivot axle housed in said flange member, a first actuator arm arranged on said pivot axle, which first actuator arm is connectable to a drive actuator, a second actuator arm arranged on said pivot axle, which second arm is connected to a pin engaged with the unison ring. Using an actuator to act on the first actuator arm turns the pivot axle and thereby the second actuator arm connected to the pivot axle. The second actuator arm, being connected to the unison ring via the pin enables pivoting of the unison ring around its rotational axis. In order to control the end positions of the vanes, in particular when the vanes are set to delimit a narrow gap in between the tips of the vanes, a stop screw is used. According to prior art the stop screw delimits the movement of the first actuator arm by defining an end stop in one of its positions. Two stop screws may be used variably defining respective end position of the vanes. Since the end position corresponding to a minimum throat area defined by the vanes requires the most precise positioning, it may be sufficient to use a stop screw for this position, while the other position may be defined by the actuator or a fixed end stop.

An example of such an arrangement is presented in U.S. Pat. No. 4,659,295. It is desirable to improve the precision in control of at least one of the maximum or minimum throat area.

According to an aspect of the invention an arrangement for controlling a variable position of vanes in a flow channel of a turbine inlet, which arrangement including a nozzle ring carrying a set of vanes is provided. The vanes are to be mounted in an annular passageway in a turbine housing. The annular passageway is connecting a scroll shaped volute defined in a turbine housing to a turbine chamber where a turbine is located. Each of said vanes being connected to a vane pin housed in the nozzle ring. The rotational position of the vanes is set by rotating the vane pin. This is accomplished via a vane displacement drive train including the following members:

- a pivotally supported pivot axle, a first actuator arm arranged on said pivot axle, which first arm is connectable to a drive actuator, a second actuator arm arranged on said pivot axle, which second arm is connected to a pin engaged with an unison ring for pivoting the unison ring, and a vane arm being connected to each vane pin and the unison ring for displacement of said vanes via pivotal displacement of the unison ring. The control of the position of the vane is thus performed by operating a bell crank system connected to a vane pin via a unison ring. The bell crank mechanism is including a pivot axle having a first and second arm. The first arm may be actuated by operation of an actuator. The second arm is connected to a unison ring via a pin. The unison ring is rotatably arranged around a nozzle ring rotatably supporting a set of vane pins. A vane arm is connecting each vane pin with the unison ring for rotation of the vane pin by turning the unison ring.

A stop screw is arranged for limiting the pivotal displacement of said vanes. According to the invention the stop screw is arranged to limit the displacement of a member in said vane displacement drive train which is located closer to the vane pin in the vane displacement drive train than said pivot axle. The ability to precisely control the position of the vanes are dependent on the precision of the position of the members in the vane displacement drive train. When the stop screw is in contact with a member to define an end position, play between the members, tolerances of the members and the non-infinite rigidity of the members, reduces the precision of the actual position of the vane. For this reason, the stop screw should be arranged to act on a member of the vane displacement drive train which is close to the vane pin.

It has shown that it is advantageous to arrange the stop screw to act on the second actuator arm of the bell crank mechanism. The bell crank mechanism is normally mounted to a flange member extending from the turbine housing, such that the pivot axle extends through the flange member, having the first actuator arm externally accessible for an actuator and the second arm being positioned inside an enclosure formed by a turbine housing and/or a flange member. By allowing the stop screw to act on the second actuator arm, it is possible to arrange a seating for the stop screw in the flange member or in the turbine housing, depending on the actual configuration of the turbine housing and/or the flange member. The turbine housing and the flange member are normally cast members. The position of the seating for the stop screw can thus be manufactured with high requirement on the tolerance at low cost in comparison with the current practice to arrange a mounting bracket on the flange member. Mounting of mounting brackets can normally not be made with a high precision at low cost. Furthermore, the brackets themselves add to the tolerance by their low rigidity and added play.

It is also advantageous to allow the stop screw to act on the unison ring. For this reason the unison ring must be provided with a stop member, which may be formed by a notch or a recess on the ring. The stop member may be positioned on the outer perimeter or on the side of the unison ring. In the event the stop screw acts on the unison ring, the stop screw will be arranged in a seating integrally arranged with the turbine housing.

In an embodiment the stop screw is arranged to limit the displacement of the vane arm. This embodiment the stop screw is located as closely as possible to the vane pin.

In a further embodiment a turbine inlet is defined in a turbine housing. A flange member is attached to said turbine housing, the flange member and/or the turbine housing defining an enclosure in which said unison ring is located. The first actuator arm will located outside the enclosure for access by an actuator mechanism. In order to have access to the stop screw while the stop screw has an end position that defines an end stop for a member in the vane displacement drive train that is located closer to the vane pin than the pivot axle of the bell crank mechanism, which pivot axle also extends through said enclosure, the stop screw extends though said enclosure.

The flange member and/or turbine housing may be formed as cast elements. A seating for the stop screw may integrally formed in one of said cast elements.

The invention also relates to a turbo arrangement including an arrangement for controlling a variable position of vanes as described above and to a combustion engine including a turbo arrangement equipped with an arrangement for controlling a variable position of vanes.

BRIEF DESCRIPTION OF DRAWINGS

The invention will be described in further detail below, with references to appended drawings where.

DETAILED DESCRIPTION

Figure 1:
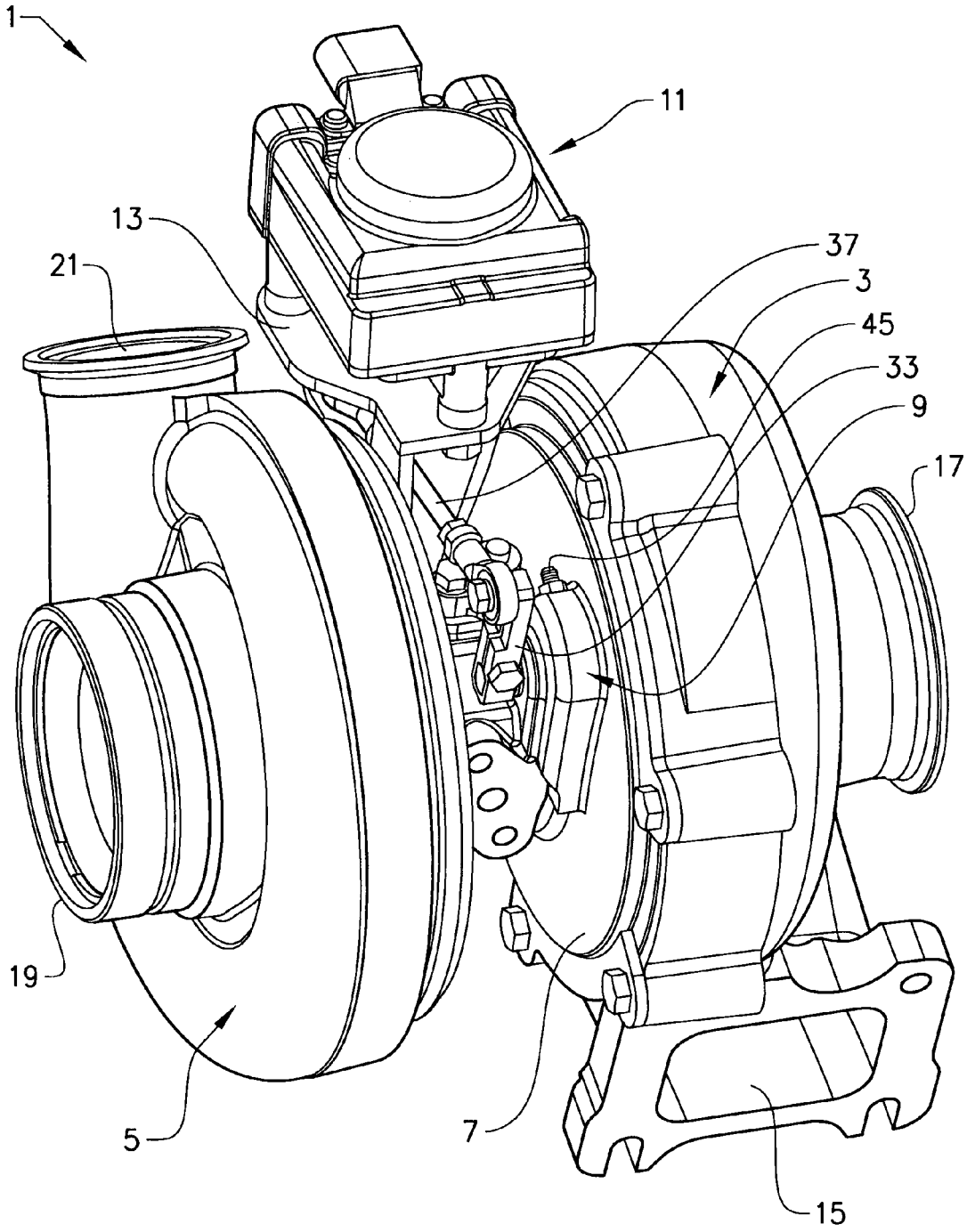
FIG. 1 shows a perspective view of a turbo arrangement according to the invention.

In FIG. 1 a turbocharger 1 for an engine is shown. The turbocharger 1 may be generally constructed as the turbocharger described in U.S. Pat. No. 4,659,295. It is however apparent that the stop screw is arranged in a different manner in U.S. Pat. No. 4,659,295, which is described in detail is the description of the invention above. All other parts of the turbocharger may be designed according to what is disclosed in U.S. Pat. No. 4,659,295.

The turbocharger 1 includes an exhaust gas turbine arranged in a turbine housing 3, a compressor arranged in a compressor housing 5, a flange member 7 mounted on a side portion of the turbine housing 3, a bearing or center housing 9 forms a passage for a shaft connecting the turbine with the compressor.

An actuator 11 is mounted on a bracket 13 connected to the compressor housing. The actuator 11 is connected to a push rod 37 connected to a first arm 33 in a vane displacement drive train.

The turbine housing includes an inlet 15 admitting exhaust gases which are fed to a scroll shaped volute 16 in the turbine housing 3, passes through an annular passageway in the turbine housing, the annular passageway connecting the scroll shaped volute to a turbine chamber. The exhaust gases are discharged via an outlet 17. The compressor housing 5 includes an inlet 19 for admitting air and a discharge opening 21.

A stop screw 45 is arranged for limiting the pivotal displacement of a vane arranged in an inlet channel to a compressor.

Figure 2:
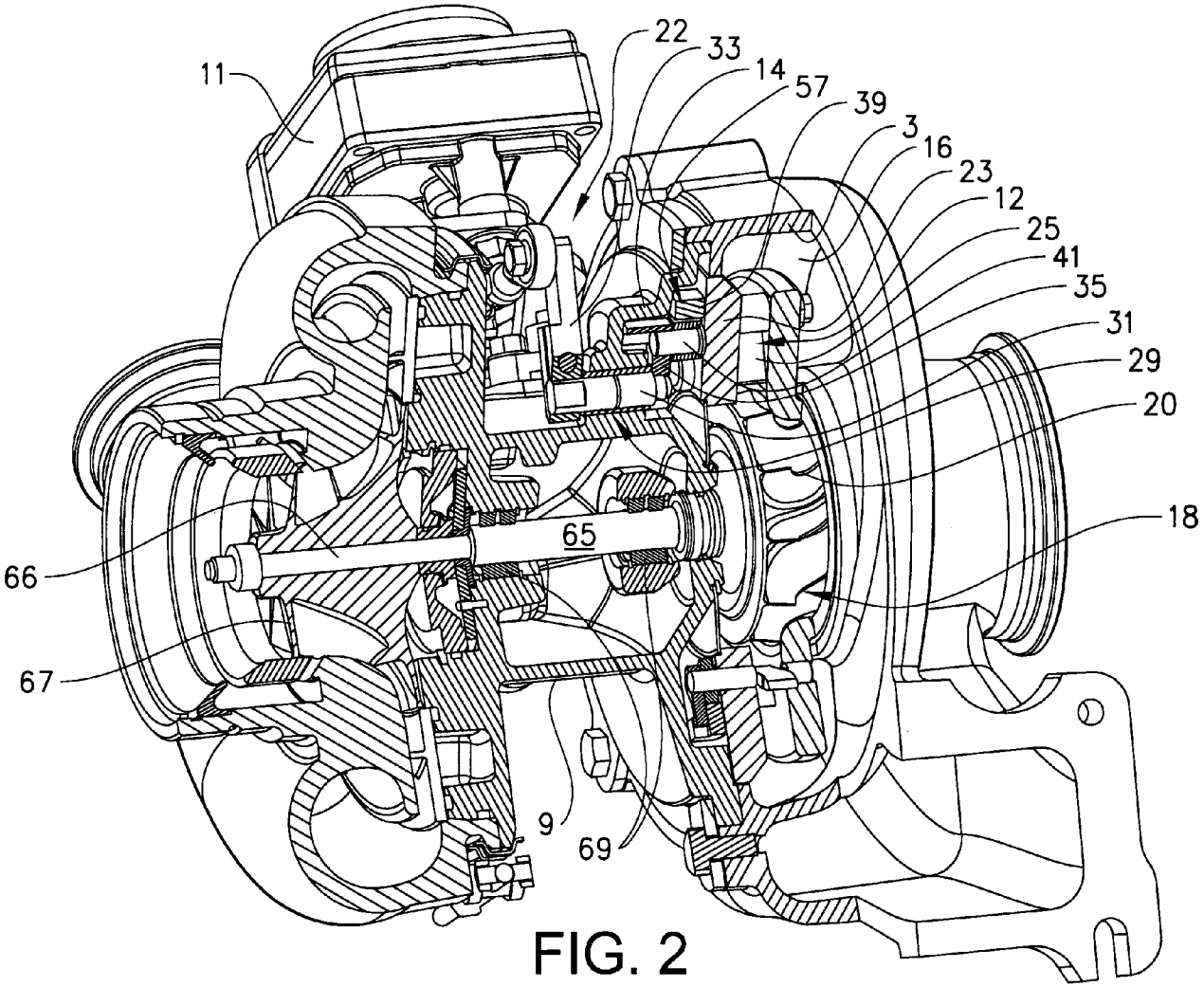
FIG. 2 shows a cross section along a length extension of the turbo arrangement shown in FIG. 1.
Figure 3:
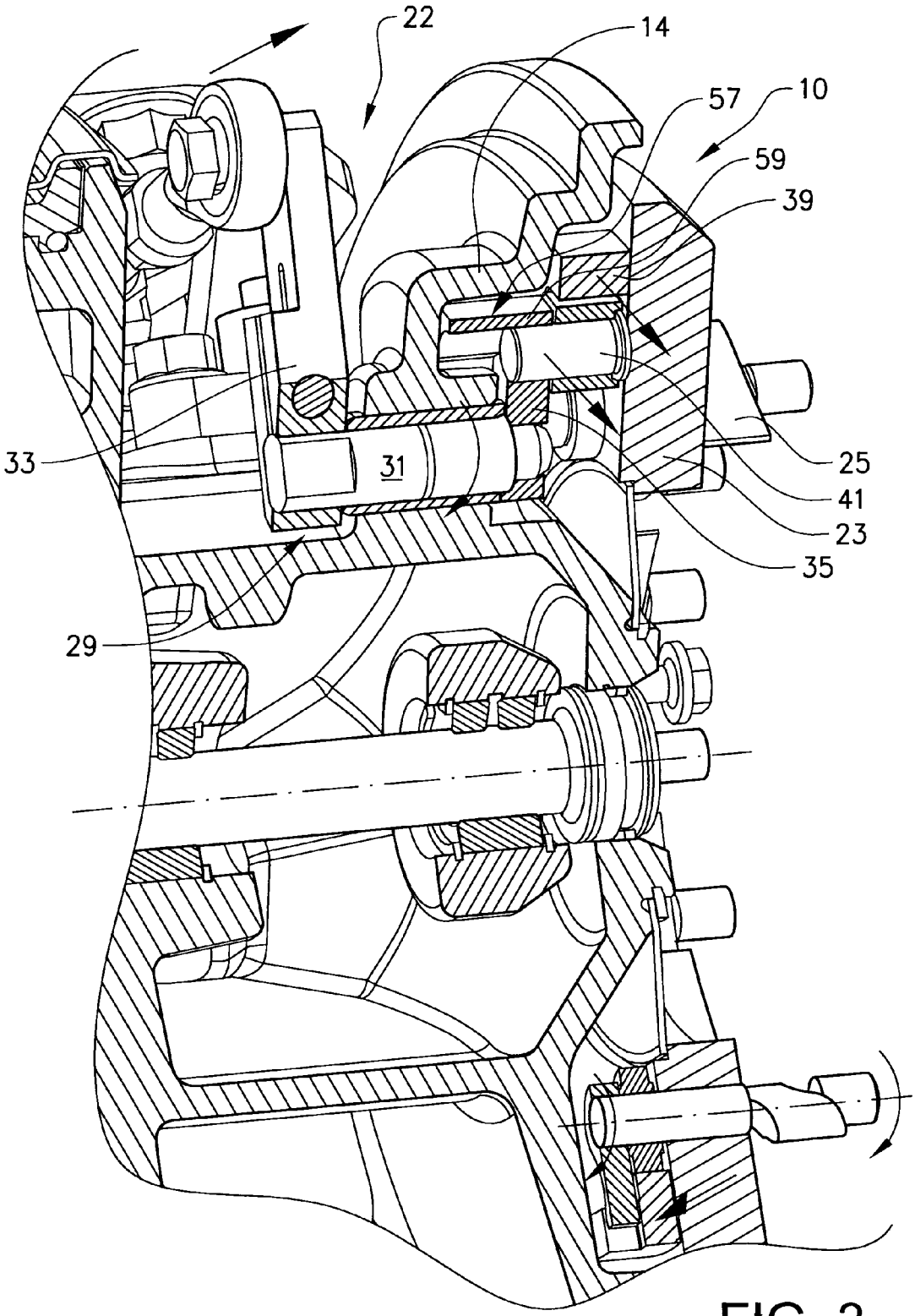
FIG. 3 shows a magnified part of the cross section shown in FIG. 2.

As is apparent from FIGS. 2 and 3, the turbine housing 3 forms a volute 16 for directing exhaust gas from an engine through an annular passage 12 to the turbine 20. The turbine 20 is rotatably mounted on a turbine shaft 65 and a compressor impeller 67 is mounted on a compressor shaft 66. The compressor housing 5 is enclosing the compressor impeller 67. The compressor shaft and turbine shaft may be made in one piece.

The center housing 9 includes bearing means 69 for rotatably supporting the turbine shaft 65 and compressor shaft 66.

Figure 4:
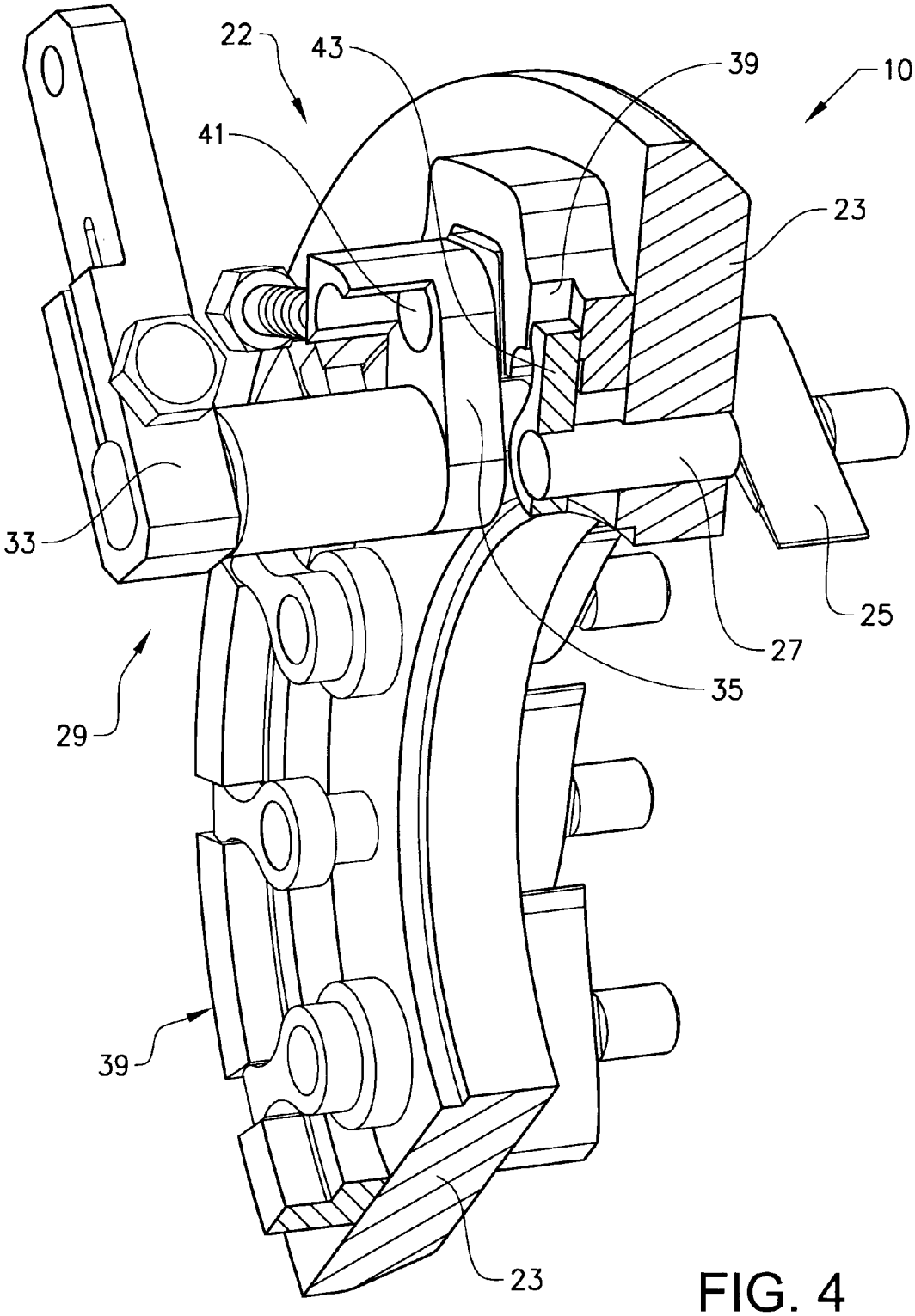
FIG. 4 shows parts of a vane displacement drive train.

As may be best illustrated in FIGS. 3 and 4 the actuator 11 is connected to an arrangement 10 for controlling a variable position of a set of vanes 25 in a flow channel of a turbine. The flow channel is preferably constituted by the annular passage 12 connecting the scroll shaped volute 16 to a turbine chamber 18. The arrangement 10 for controlling the variable position of the vanes 25 includes a nozzle ring 23 is carrying a set of vanes 25, each of said vanes 25 being connected to a vane pin 27 housed in the nozzle ring 23.

The arrangement 10 for controlling the variable position of the vanes 25 furthermore includes a vane displacement drive train 22. The parts of a vane displacement drive train 22 is found in FIG. 4. A rotational position of the vanes 25 is set via the vane displacement drive train 22. The vane displacement drive train 22 thus allow for a setting of a pivotal angle of the vane due to turning of the vane pin 27.

The vane displacement drive train 22 includes a bell crank mechanism 29, a unison ring 39, a pin 41 connecting the bell crank mechanism with the unison ring 39 and a vane arm 43 connecting the vane pin 27 with the unison ring 39. The bell crank mechanism 29 is connected to the vane pin 27 via a unison ring 39. The bell crank mechanism 29 is including a pivot axle 31 having a first and second arm 33, 35. The first arm 33 may be actuated by operation of the actuator 11. For this purpose the actuator 11 is connected to the push rod 37 connected to the first arm 33. The vane displacement drive train 22 furthermore includes the unison ring 39. The second arm 35 is connected to the unison ring 39 via a pin 41. The unison ring 39 is rotatably arranged with respect to the nozzle ring 23 rotatably supporting a set of vane pins 27. A vane arm 43 is connecting each vane pin 27 with the unison ring 39 for rotation of the vane pin 27 by turning the unison ring 39. A more detailed description of the function of the unison and nozzle rings is provided in U.S. Pat. No. 4,659,295.

The vane displacement drive train 22 is thus including the following members: a pivotally supported pivot axle 31, a first actuator arm 33 arranged on said pivot axle 31, which first arm 31 is connectable to a drive actuator 11, a second actuator arm 35 arranged on said pivot axle 31, which second arm 35 is connected to a pin 41 engaged with an unison ring 39 for pivoting the unison ring 39, a vane arm 43 being connected to each vane pin 27 and the unison ring 39 for displacement of the vanes 25 via pivotal displacement of the unison ring 39.

Figure 5:
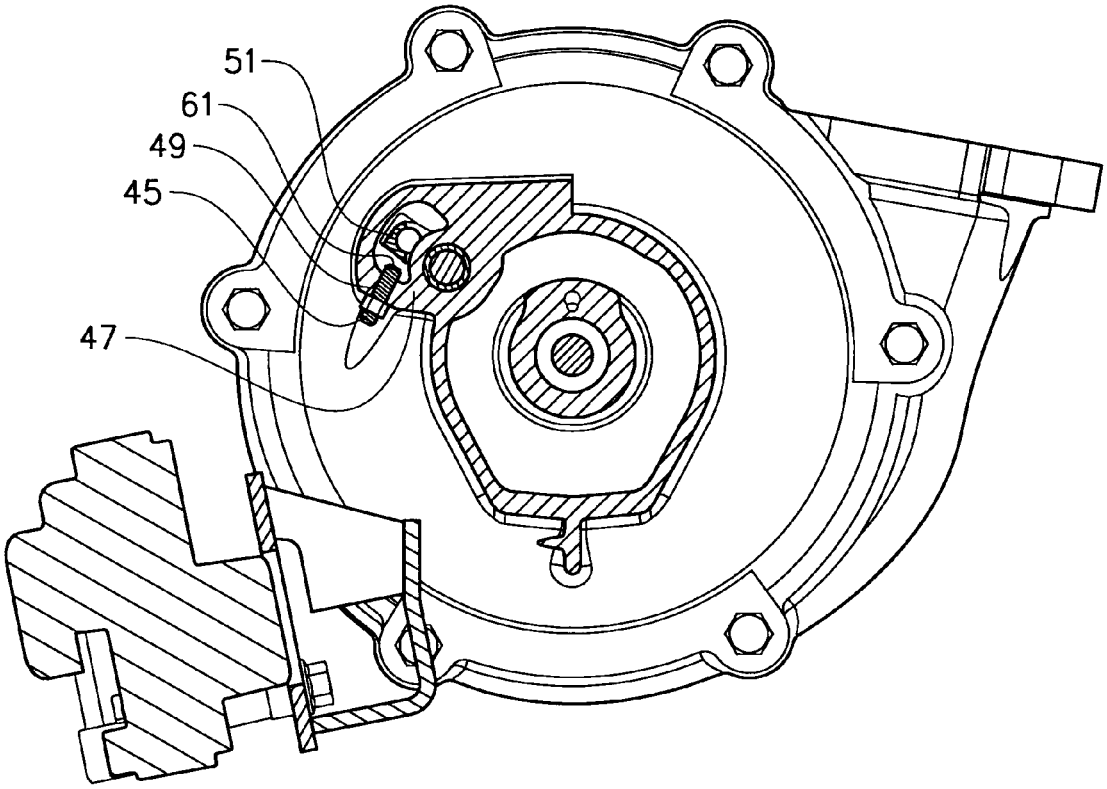
FIG. 5 shows a cross section taken at the position 4-4 across a length extension of the turbo arrangement shown in FIG. 1 in a view toward the turbine housing.
Figure 6A:
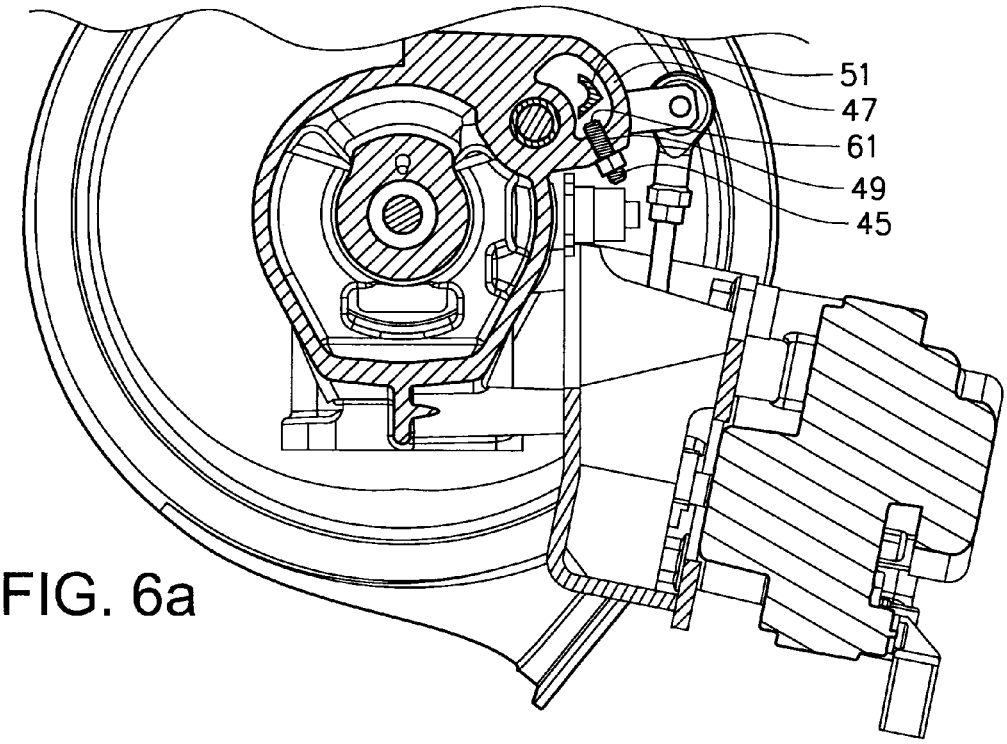
FIG. 6*a* shows a cross section taken at the position 4-4 across a length extension of the turbo arrangement shown in FIG. 1 in a view toward the compressor housing.
Figure 6B:
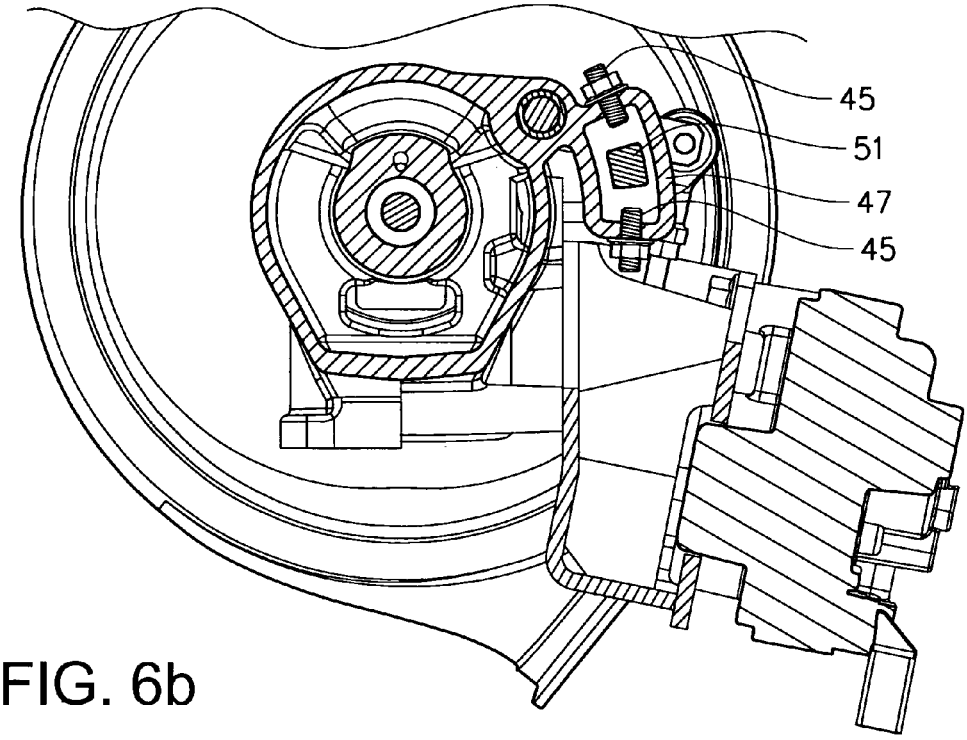
FIG. 6*b* shows an alternative embodiment where two set screws are used.

A stop screw 45 is arranged for limiting the pivotal displacement of said vane. The stop screw 45 is arranged to limit the displacement of a member in said vane displacement drive train which is located closer to the vane pin in the vane displacement drive train than said pivot axle. In the embodiment shown in FIGS. 1-6, the stop screw 45 stop screw is arranged to limit the displacement of the second actuator arm 35. As best seen in FIGS. 5, 6*a* and 6*b* the stop screw 45 is arranged on a seating 47 integrally formed in the flange member 7. With integrally formed is intended that the flange member is a cast member and that the seat for the stop screw is part of the cast Member. A bore 49 allows the stop screw to be externally accessible while reaching the second arm or a protrusion 51 on the second arm which serves as an abutment member for the stop screw 45.

FIG. 6*a* shows an embodiment where a single step screw for limiting the movement in one direction is used, while FIG. 6*b* shows an embodiment where two set screws are used for limiting the movement in two directions.

Figure 7:
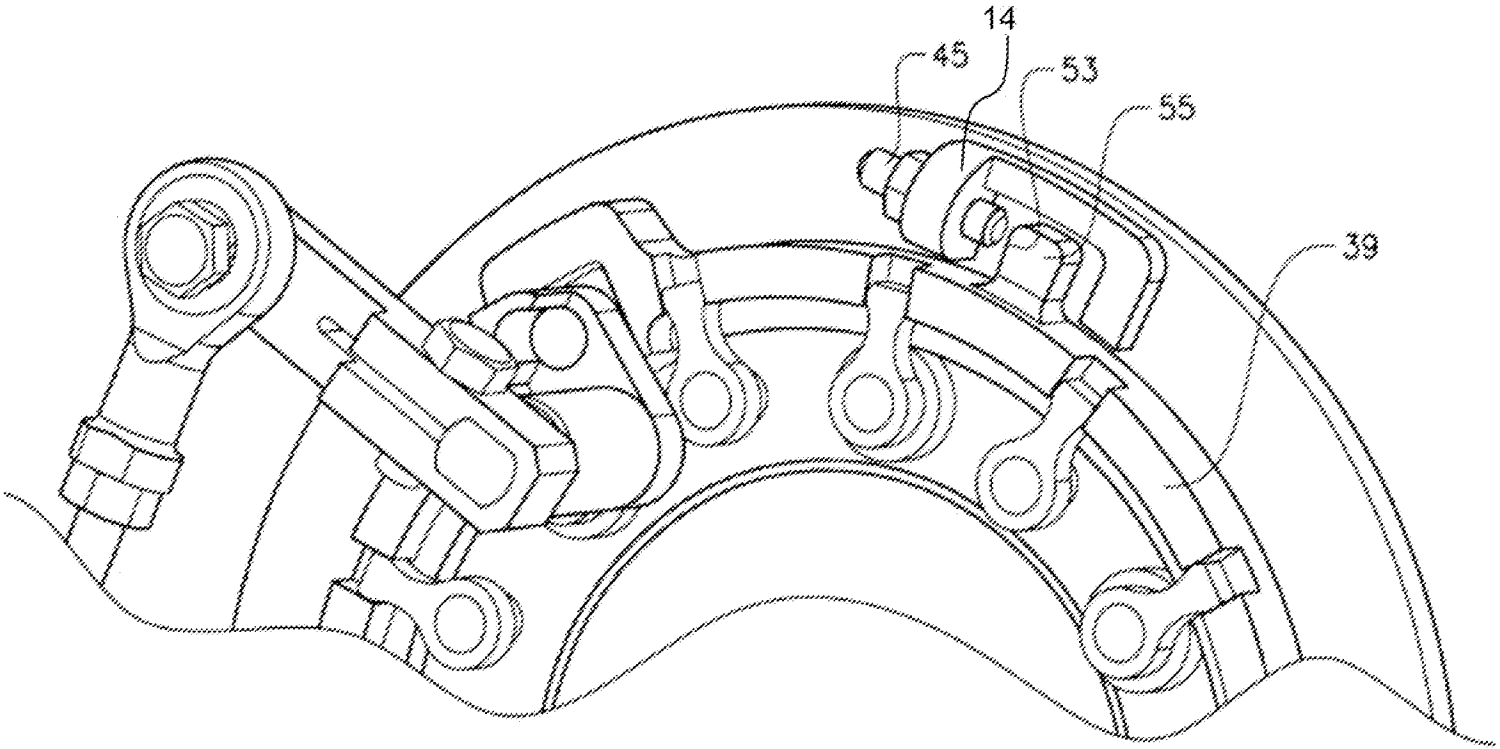
FIG. 7 shows a second embodiment of the invention where a stop screw engages with a stop surface on the unison ring.

In a further embodiment as shown in FIG. 7 the stop screw 45 can be designed to limit the displacement of the unison ring 39. For this purpose the unison ring 39 may be equipped with a recess or protrusion defining a stop surface extending in a radial direction. The stop surface 53 may be accessible through a flange member or bracket 14. In FIG. 7 a schematic drawing of a unison ring 39 being provided with a stop surface 53 for engagement with a stop screw 45 extending through a flange member 14 is shown. The stop surface 53 is here part of a protrusion 55 but it would be equally suitable to form the stop surface as a part of a wall defining a recess.

Figure 8:
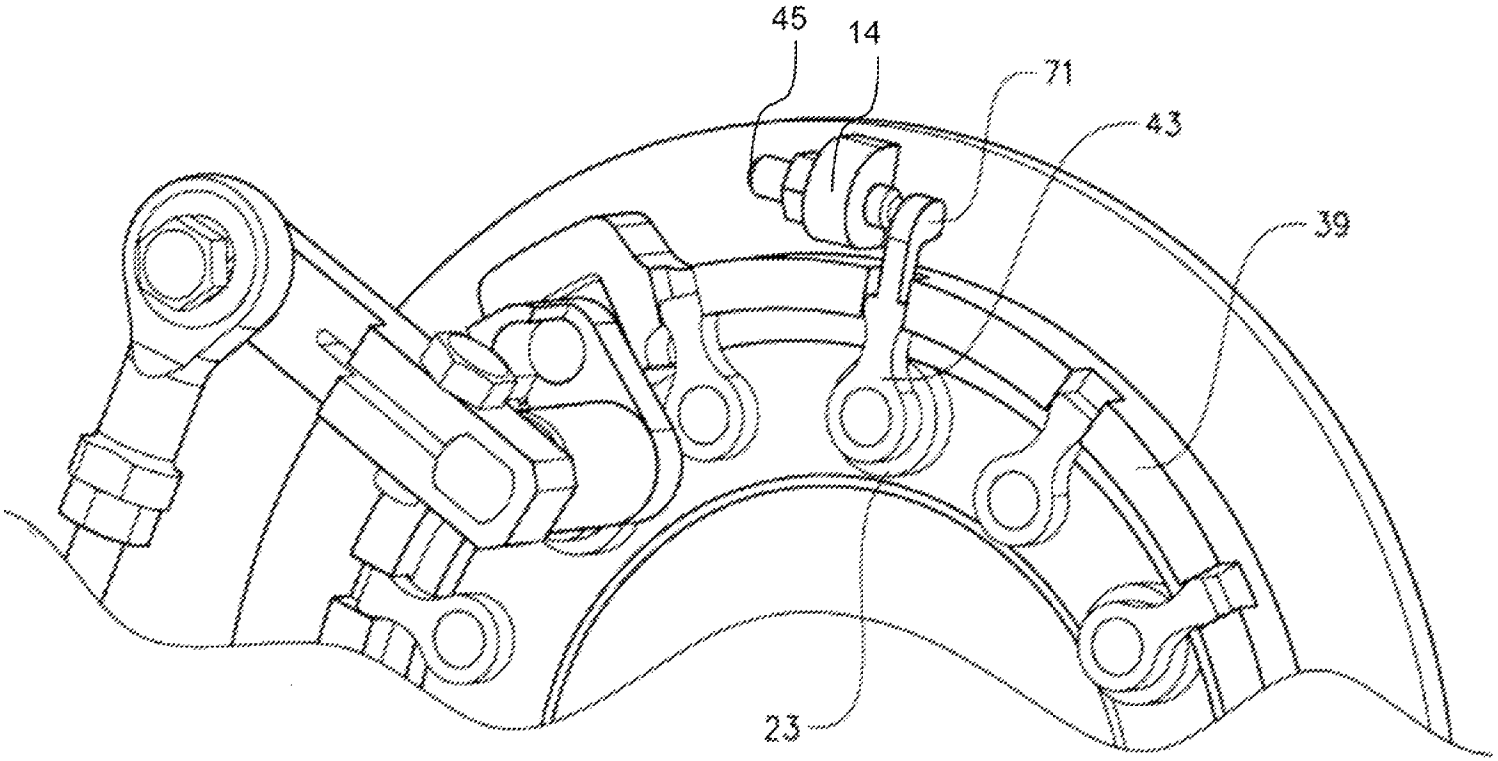
FIG. 8 shows a second embodiment of the invention where a stop screw engages with a stop surface on the vane arm.

In a further embodiment as shown in FIG. 8 the stop screw 45 can be designed to limit the displacement of the vane arm 43. A stop surface 71 of the vane arm may be accessible through a flange member or bracket 14. In FIG. 8 a schematic drawing of a vane arm 43 being provided with the stop surface 71 for engagement with a stop screw 45 extending through a flange member 14 is shown.

As is evident from FIGS. 2 and 3, the turbine inlet 15 is defined in a turbine housing 3 and a flange member 14 is attached to said turbine housing 3. The flange member 14 and/or the turbine housing 3 defining an enclosure 57 forming a cavity 59 in which said unison ring 39 is located. The first actuator arm 33 is located outside said enclosure 57. The stop screw 45 extends though the enclosure 57 to define an end stop 61 for the member 35,39,43 in said vane displacement drive train 22 which said stop screw 45 engages with. The end stop 61 may suitable be formed by an end portion of the stop screw 45.

The invention claimed is:

1. Arrangement for controlling a variable position of a set of vanes in a flow channel of a turbine, the arrangement including a nozzle ring carrying the set of vanes, each of the vanes being connected to a vane pin housed in the nozzle ring, and a vane displacement drive train arranged to control a rotational position of the vanes in the flow channel, the vane displacement drive train including the following members:

a pivotally supported pivot axle, a first actuator arm arranged on the pivot axle, which first actuator arm is connectable to a drive actuator, a second actuator arm arranged on the pivot axle, which second actuator arm is connected to a pin engaged with an unison ring for pivoting the unison ring, and a vane arm being connected to each vane pin and the unison ring for displacement of the vanes via pivotal displacement of the unison ring, and wherein a stop screw is arranged for limiting the pivotal displacement of the vanes, the first actuator arm is located outside an enclosure forming a cavity in which the unison ring is located and is externally accessible for the drive actuator and the second actuator arm being positioned inside the enclosure, wherein the stop screw is arranged to limit the displacement of a member in the vane displacement drive train which is located closer to the vane pin in the vane displacement drive train than the pivot axle, and in that the stop screw extends through the enclosure to define an end stop for the member in the vane displacement drive train which the stop screw engages with.

2. Arrangement for controlling a variable position of vanes according to claim 1, wherein the stop screw is arranged to limit the displacement of the second actuator arm, the second actuator arm constituting the member.

3. Arrangement for controlling a variable position of vanes according to claim 1, wherein the stop screw is arranged to limit the displacement of the unison ring, the unison ring constituting the member.

4. Arrangement for controlling a variable position of vanes according, to claim 1, wherein the stop screw is arranged to limit the displacement of the vane arm, the vane arm constituting the member.

5. Arrangement for controlling a variable position of vanes according to claim 1, wherein a turbine inlet is defined in a turbine housing, a flange member is attached to the turbine housing, the flange member and/or the turbine housing defining the enclosure.

6. Arrangement for controlling a variable position of vanes according to claim 1, wherein the stop screw is attached in a bore arranged in a flange member or a turbine housing.

7. Arrangement for controlling, a variable position of vanes according to claim 6, wherein the flange member and/or turbine housing are cast elements and that a seating for the stop screw is integrally formed in one of the cast elements.

8. A turbocharger for an engine including:

a turbine rotatably mounted on a shaft, a compressor impeller mounted on a shaft, a compressor housing having an inlet and an outlet and enclosing the compressor impeller, a center housing including bearing means for rotatably supporting the turbine shaft and compressor shaft, a turbine housing including an inlet and an outlet, the turbine housing forming a volute therein for directing exhaust gas from an engine through an annular passage to the turbine, a flange member mounted between the center housing and the turbine housing, and an arrangement for controlling a variable position of vanes in an annular passage, the arrangement including a nozzle ring carrying the set of vanes, each of the vanes being connected to a vane pin housed in the nozzle ring, and a vane displacement drive train arranged to control a rotational position of the vanes in the flow channel, the vane displacement drive train including the following members:

a pivotally supported pivot axle, a first actuator arm arranged on the pivot axle, which first actuator arm is connectable to a drive actuator, a second actuator arm arranged on the pivot axle, which second actuator arm is connected to a pin engaged with an unison ring for pivoting the unison ring, and a vane arm being connected to each vane pin and the unison ring for displacement of the vanes via pivotal displacement of the unison ring, and wherein a stop screw is arranged for limiting the pivotal displacement of the vanes, the first actuator arm is located outside an enclosure forming a cavity in which the unison ring is located and is externally accessible for the drive actuator and the second actuator arm being positioned inside the enclosure, wherein the stop screw is arranged to limit the displacement of a member in the vane displacement drive train which is located closer to the vane pin in the vane displacement drive train than the pivot axle, and in that the stop screw extends through the enclosure to define an end stop for the member in the vane displacement drive train which the stop screw engages with.

9. An engine comprising:

a turbocharger, the turbocharger including:

a turbine rotatably mounted on a shalt, a compressor impeller mounted on a shaft, a compressor housing having an inlet and an outlet and enclosing the compressor impeller, a center housing including bearing means for rotatably supporting the turbine shaft and compressor shaft, a turbine housing including an inlet and an outlet, the turbine housing forming volute therein for directing exhaust gas from an engine through an annular passage to the turbine, a flange member mounted between the center housing and the turbine housing, and an arrangement for controlling a variable position of vanes in an annular passage, the arrangement including a nozzle ring carrying the set of vanes, each of the vanes being connected to a vane pin housed in the nozzle ring, and a vane displacement drive train arranged to control a rotational position of the vanes in the flow channel, the vane displacement drive train including the following members:

a pivotally supported pivot axle, a first actuator arm arranged on the pivot axle, which first actuator arm is connectable to a drive actuator, a second actuator arm arranged on the pivot axle, which second actuator arm is connected to a pin engaged with an unison ring for pivoting the unison ring, and a vane arm being connected to each vane pin and the unison ring for displacement of the vanes via pivotal displacement of the unison ring, and wherein a stop screw is arranged for limiting the pivotal displacement of the vanes, the first actuator arm located outside an enclosure forming a cavity in which the unison ring is located and is externally accessible for the drive actuator and the second actuator arm being, positioned inside the enclosure, wherein the stop screw is arranged to limit the displacement of a member in the vane displacement drive train which is located closer to the vane pin in the vane displacement drive train than the pivot axle, and in that the stop screw extends through the enclosure to define an end stop for the member in the vane displacement drive train which the stop screw engages with.

* * * * *